United States Patent [19]

Keller et al.

[11] Patent Number: 5,047,107

[45] Date of Patent: Sep. 10, 1991

[54] METHOD AND APPARATUS FOR APPLYING A REFLECTIVE SLEEVE TO A TRAFFIC CONE

[75] Inventors: Louis F. Keller, New Brighton; James P. McAuley, Shoreview; Heinrich F. Stenemann, Woodbury, all of Minn.

[73] Assignee: Minnesota Mining and Manufacturing Company, St. Paul, Minn.

[21] Appl. No.: 371,919

[22] Filed: Jun. 27, 1989

[51] Int. Cl.[5] ..... B65C 3/00

[52] U.S. Cl. ..... 156/184; 156/189; 156/446; 156/447; 156/456; 156/215; 493/112

[58] Field of Search ..... 156/446–449, 156/456–458, 475, 184, 189, 215; 493/105–107, 112, 296

[56] References Cited

U.S. PATENT DOCUMENTS

| | | | |
|---|---|---|---|
| 2,081,911 | 6/1937 | Coppins | 493/112 |
| 3,455,758 | 7/1969 | Struaughan | 156/215 |
| 3,616,055 | 10/1971 | Mages | 156/215 |
| 3,709,112 | 1/1973 | Ebinger | 94/1.5 |
| 3,768,383 | 10/1973 | Tucker | 116/63 R |
| 3,920,348 | 11/1975 | Raulos | 404/72 |
| 3,952,690 | 4/1976 | Rizzo et al. | 116/63 P |
| 3,963,362 | 6/1976 | Hollis | 404/10 |
| 4,111,581 | 9/1978 | Auriemma | 404/10 |
| 4,123,181 | 10/1978 | Schueler et al. | 404/9 |
| 4,197,807 | 4/1980 | Campbell | 116/63 P |
| 4,221,498 | 9/1980 | Schueler et al. | 404/9 |
| 4,245,922 | 1/1981 | Auriemma | 404/10 |
| 4,343,567 | 8/1982 | Sarver et al. | 404/10 |
| 4,397,710 | 8/1983 | Gaylord | 156/475 |
| 4,571,118 | 2/1986 | Schmanski | 404/10 |
| 4,573,763 | 3/1986 | Thomas | 350/105 |
| 4,661,949 | 9/1986 | Schmanski | 404/9 |

FOREIGN PATENT DOCUMENTS

| | | |
|---|---|---|
| 2406696 | 5/1979 | France . |
| 2500505 | 8/1982 | France . |
| 2516564 | 5/1983 | France . |
| 2096214B | 10/1981 | United Kingdom . |
| 2139116B | 3/1984 | United Kingdom . |
| 2140547 | 11/1984 | United Kingdom . |

OTHER PUBLICATIONS

Brochure Entitled "Charged for Safety", From the *Work Area Protection Corp.*, Undated; Two Pages.

*Primary Examiner*—David A. Simmons
*Assistant Examiner*—James J. Engel, Jr.
*Attorney, Agent, or Firm*—Gary L. Griswold; Walter N. Kirn; Leland D. Schultz

[57] ABSTRACT

A method and apparatus for applying one or more reflective sleeves to a traffic cone. The sleeve is supported on a platform and the traffic cone is positioned in contact with one end edge of the sleeve and rotated to wind the sleeve onto the traffic cone.

20 Claims, 5 Drawing Sheets

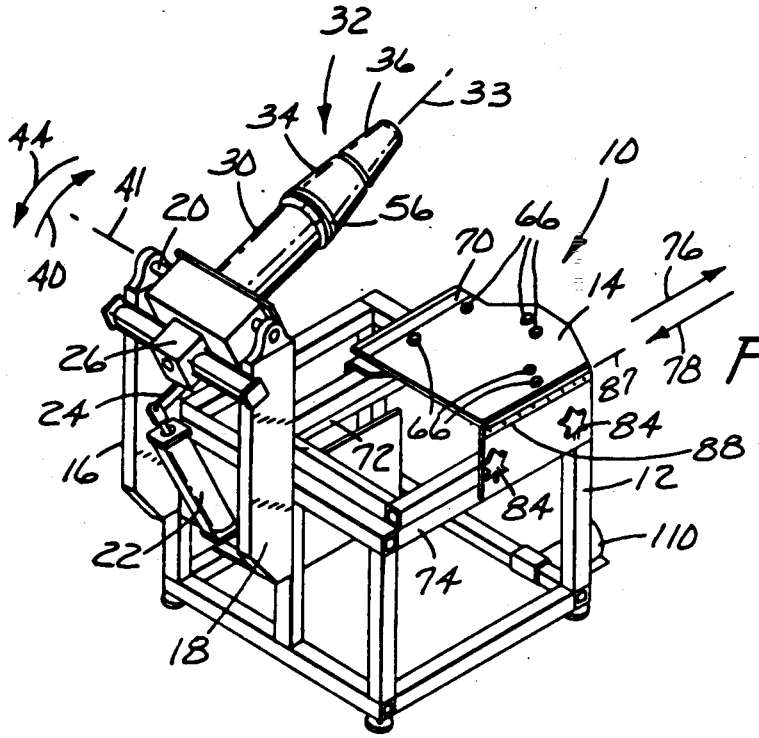
Fig. 1
Fig. 3
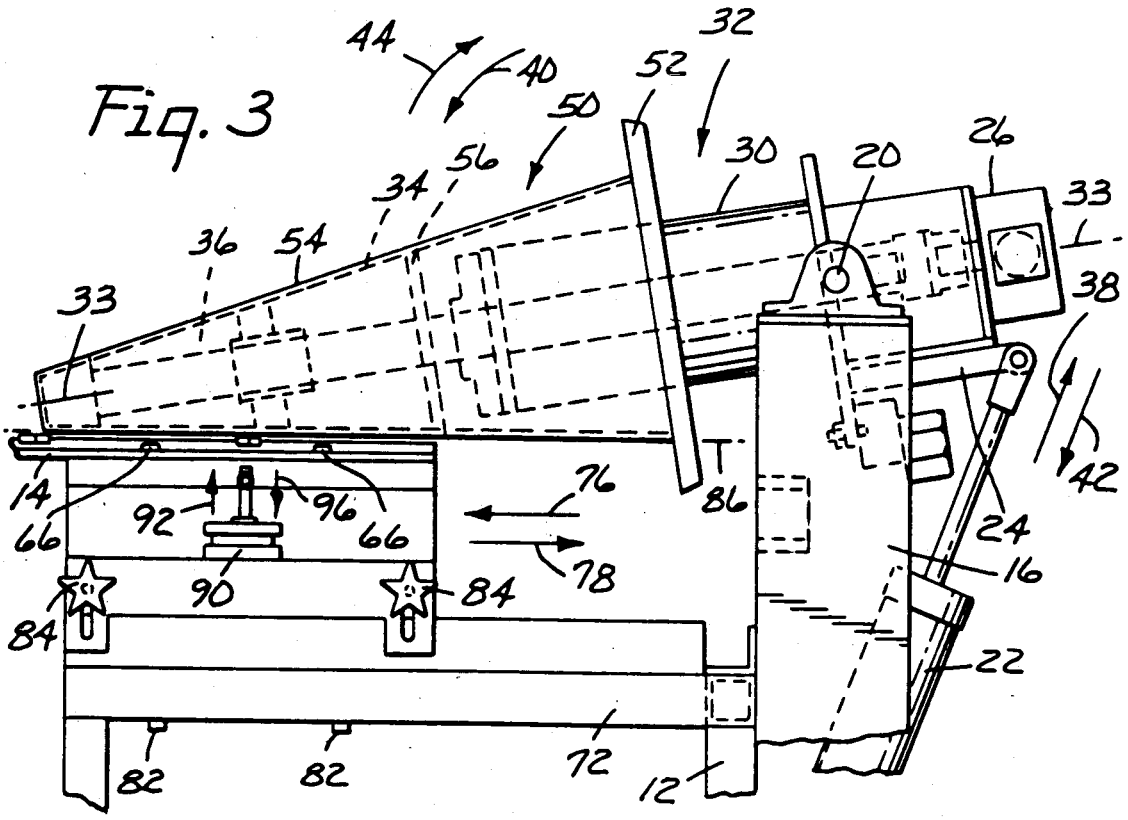

METHOD AND APPARATUS FOR APPLYING A REFLECTIVE SLEEVE TO A TRAFFIC CONE

TECHNICAL FIELD

The present invention relates to methods and apparatus for adhesively applying a reflective sleeve to a traffic cone.

BACKGROUND ART

It has been known in the past to apply a sleeve of reflective material to a traffic cone. For the purposes of this invention, the term "traffic cone" includes, but is not limited to, bodies integrally formed from a flexible polymeric material and having a base portion for supporting an upright, generally conical or cylindrical member.

In the case of traffic cones, it is desirable to adhesively apply reflectorized sheeting material to the exterior of the upright member in order to enhance the visibility of the traffic cone at night or other times of poor visibility. Application of reflective sleeves to a traffic cone has become even more important recently as the latest edition of the Manual on Uniform Traffic Devices (Section 6C-3 Cone Design) promulgated by the Federal Highway Administration (the contents of which are incorporated herein by reference) requires that traffic cones for use on freeways be at least 28 inches in height and if utilized at night, must include two reflective bands three inches in width, one placed a maximum of two inches from the top of the traffic cone and the other band spaced a maximum of six inches from the first band. Alternatively, a six inch wide reflective band may be placed nominally three inches from the top of the traffic cone and a four inch wide reflective sleeve placed two inches below the six inch band. Preferably, the reflective bands must be located within a tolerance of ±0.125 inches. Such reflective sheeting may be applied manually, but such a process is slow and therefore expensive and requires considerable skill if accuracy is desired.

U.K. Patent No. 2,096,214 A entitled "Portable Road Markers", commonly assigned to the assignee of the present invention, discloses a method and apparatus for applying a narrow pressure sensitive adhesive tape having a reflective surface opposite the adhesive surface, to a traffic cone or "bollard". The method provides for rotating the tape applying apparatus relative to the traffic cone and means for severing the tape when a sufficient length has been applied to the traffic cone. Means are also provided so that the traffic cone and the tape applying apparatus may be axially shifted relative to each other so that the tape may be applied in a generally helical fashion, although it is contemplated that the tape may be applied in one or more concentric bands. On page 2, lines 44–79, the U.K. '214 patent discusses the difficulties in applying a preformed adjustable sleeve of adhesively secured reflective material to a precise location on a traffic cone.

Therefore, it would be desirable to provide a method and apparatus for quickly and accurately applying one or more reflective sleeves to a traffic cone.

DISCLOSURE OF INVENTION

The present invention provides a method and apparatus for adhesively applying a reflective sleeve to a traffic cone. The method for applying a reflective sleeve to a traffic cone comprises the steps of: providing a traffic cone having a longitudinal axis; providing a reflective sleeve having one major surface coated with a pressure sensitive adhesive and having spaced end edges; positioning the traffic cone adjacent to one end edge of the sleeve with the nearest tangent line of the traffic cone aligned with but spaced from an end edge of the sleeve; placing the adjacent end edge of the sleeve in contact with the traffic cone at the nearest tangent line; rotating the traffic cone about its longitudinal axis to wind up the sleeve on the traffic cone; and removing the traffic cone with the reflective sleeve from the mandrel.

According to the present invention there is also provided apparatus for practicing the above method, comprising: a frame; a mandrel having a longitudinal axis mounted on said frame for receiving the traffic cone and including means for securing the traffic cone on said mandrel; a platform mounted on said frame for supporting the reflective sleeve with a pressure sensitive adhesive surface of the reflective sleeve exposed; means mounted on said frame for shifting said mandrel with the traffic cone secured thereon between a first position and a second position so that a tangent line of the traffic cone nearest to said platform is parallel to and spaced from an end edge of the sleeve; means mounted on said frame for shifting said platform between a first position to a second position with said mandrel in said second position to place the pressure sensitive adhesive surface of the adhesive sleeve along said end edge thereof in contact with the traffic cone at the nearest tangent line; and means mounted on said frame for rotating said mandrel about said longitudinal axis to wind the sleeve onto the traffic cone.

BRIEF DESCRIPTION OF DRAWINGS

The present invention will be further described with reference to the accompanying drawing wherein like reference numerals refer to like parts in the several views, and wherein:

FIG. 1 is a isometric view of an apparatus according to the present invention with a mandrel in a first, or raised, position.

FIG. 3 is a side view of a portion of the apparatus of FIGS. 1 and 2 with the mandrel lowered to a second position spaced from a platform in a first, or lowered position, and supporting a pair of reflective sleeves.

DETAILED DESCRIPTION

Figure 2:
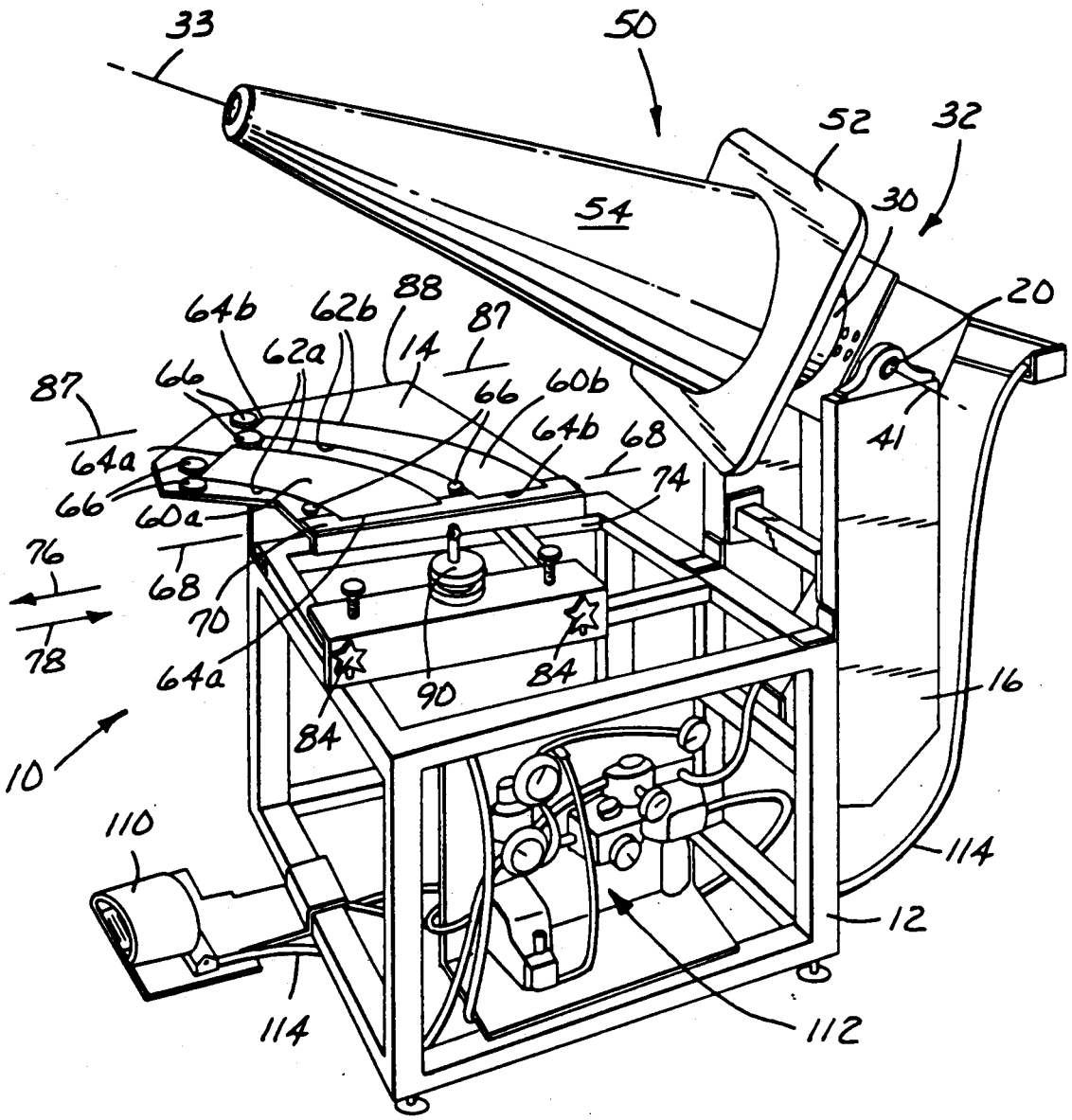
FIG. 2 is another isometric view of the apparatus of FIG. 1 with a traffic cone mounted on the mandrel in the first position.

Referring now to the drawing, there is shown apparatus according to the present invention generally designated by the reference numeral 10. Generally, the apparatus 10 comprises frame 12 for supporting the remainder of the apparatus. Platform 14 is horizontally mounted on the frame and will be explained in greater detail hereinafter. Upwardly extending brackets 16 and 18 are mounted on the back edge of frame 12. Rod 20 extends between brackets 16 and 18 and is pivotally mounted thereon. Double acting first pneumatic cylinder 22 is connected at one end to frame 12 and the shaft thereof is connected by crank arm 24 to rod 20. Pneumatic motor 26 is mounted on rod 20. Bearing 30 is mounted on motor 26. Mandrel 32 includes longitudinal axis 33 and is rotatively supported by bearing 30 and connected to motor 26 to extend over platform 14. Mandrel 32 includes stationary portion 34 and adjustable portion 36 which is capable of reciprocal movement along axis 33 with respect to the stationary portion. The adjustable portion is biased by a spring or the like (not shown) outwardly from the stationary portion with sufficient force to maintain the position shown in FIG. 1. Extension of the shaft of pneumatic cylinder 22 in direction 38 will cause rotation of rod 20, motor 26, bearing 30 and mandrel 32 in direction 40 about an axis 41 extending through rod 20 and generally perpendicular to the longitudinal axis 33 of the mandrel. Retraction of the shaft in opposite direction 42 will cause rotation of rod 20 and mandrel 32 in opposite rotational direction 44 about axis 41.

As is shown in FIG. 2, traffic cone 50 includes base 52 and upright member 54, both shown generally frusto conical in shape, although the present invention may also be employed with traffic cones having a generally cylindrical upright member and therefore would require a generally cylindrical mandrel. Preferably, traffic cone 50 is constructed of a monolithic molded polymeric material such as plasticized polyvinyl chloride or polyolefins such as polyethylene. The following are examples of commercially available traffic cones which may be used with the present invention: Model 28 PVCS available from Work Area Protection Corp. of St. Charles, Illinois; Model TC-28FL available from Service and Materials Co. of Elwood, Indiana; Model 2850-7 available from Lakeside Plastics Inc. of Oshkosh, Wisconsin.

Traffic cone 50 may be mounted on the apparatus by mandrel 32 by sliding the traffic cone on the mandrel until the interior of the traffic cone encounters stationary portion 34. Preferably, stationary portion 34 is adapted to frictionally grip traffic cone 50 to secure it thereon. For instance, a concentric ring 56 of Safety-Walk TM brand sheeting available from Minnesota Mining and Manufacturing Co. of St. Paul, Minnesota may be adhered to the stationary portion for gripping the traffic cone when pushed onto the mandrel. The frictional sheeting provides sufficient force to hold the traffic cone in position while the reflective sleeves are applied, yet permits easy manual removal.

Both portions 34, 36 of mandrel 32 are tapered at the nominal taper of the traffic cone to be used with the apparatus. When a traffic cone is not mounted on the mandrel, adjustable portion 36 is biased to an extreme position away from stationary portion 34, as shown in FIG. 1. Due to the large tolerances inherent in the manufacture of traffic cones as well as the deformable nature of the polymeric material normally used to construct traffic cones, the internal taper of individual traffic cones may not match the nominal taper of mandrel 32. This results in misplacement of the traffic cone on the mandrel and deformation of the traffic cone in areas that the reflective sleeves are to be applied. In either case, the reflective sleeves may not be accurately or reliably applied to the traffic cone.

The illustrated mandrel 32 is constructed to accommodate the variations in traffic cones due to the reciprocal movement of adjustable portion 36 with respect to stationary portion 34. If the taper of a particular traffic cone is less than the nominal taper of the mandrel, adjustable portion 36 of the mandrel will be retracted slightly as the traffic cone is slid onto the mandrel and contacts stationary portion 34. If a traffic cone has a taper that is greater than nominal, adjustable portion 36 will be pushed closer to stationary portion 34 of the mandrel.

In either of the above situations, the mandrel securely holds the traffic cone in a desired location relative to the platform and each of the portions 34, 36 of mandrel 32 underlay and support the segments of traffic cone 50 on which the reflective sleeves are to be applied. Of course, a mandrel may be constructed with more than two portions to more closely conform to the actual taper of individual traffic cones. This may also be desirable if more than two reflective sleeves are to be applied to a traffic cone.

Platform 14 is also shown in more detail in FIG. 2. A pair of sleeves **60*a* and 60*b* are shown for application to the traffic cone. Although two sleeves are illustrated, the method and apparatus of the present invention are equally adapted to apply one or more than two sleeves to a traffic cone. The sleeves, although varying in dimensions, each include longitudinal edges 62*a*, 62*b* and spaced end edges 64*a*, 64*b***, respectively. If the upright member of the traffic cone is frusto conical in shape, then the longitudinal edges of the reflective sleeves will be arcuate and concentric to accommodate the variation in the circumference of the upright member along its length. If the upright member is cylindrical, then the longitudinal edges are linear and parallel and all sleeves would be the same length.

One major surface of the sleeves includes a reflective material or coating and the opposite major surface is coated with a pressure sensitive adhesive. Model Nos. 3840 and 3810 brand reflective sheeting available from Minnesota Mining and Manufacturing Co. of St. Paul, Minnesota are examples of reflective sheeting that may be used with the traffic cones listed above, as well as others, in the process and with the apparatus of this invention.

Means are provided to precisely locate the sleeves with respect to the platform. In the illustrated embodiment, the location means includes stops 66. The stops contact the longitudinal and end edges of the reflective sleeves **60*a*, 60*b* as shown to precisely determine the location of the sleeves with respect to the platform and specifically to align a pair of end edges 64*a*, 64*b* of each sleeve along a line 68 as shown in FIG. 2. Preferably, a cushion or resilient strip 70 is mounted on the platform to support end edges 64*a*, 64*b* of sleeves 60*a*, 60*b* as the sleeves are applied to the traffic cone, as will be explained in greater detail hereinafter. Conveniently, cushion 70** is mounted within a recessed groove (not shown) formed in the platform so that the upper surface of the cushion is generally flush with the platform.

Stops 66 may be made adjustable, such by threadedly securing them to the platform and by providing alternate threaded holes (not shown) in the platform so that the stops may be resecured to the platform in different locations to accommodate sleeves of different dimensions. Further, stops 66 may be eccentrically mounted to the platform so that rotation of a stop about the threaded connection enables a finer adjustment in the location of sleeves 60*a*, 60*b* with respect to the platform. Alternatively, recesses (not shown) could be formed in the platform for receipt of the reflective sleeves.

Further, the position of platform 14 relative to frame 12 and mandrel 32 may be adjusted. In the illustrated embodiment, the adjustment of the platform is accomplished by slidingly mounting the platform on rails 72 and 74, enabling movement of the platform in opposite directions 76 and 78 parallel to line 68. Platform 14 may be secured in a desired longitudinal position relative to the mandrel by screws 82 which are threadedly engaged with the platform and may be tightened to contact rails 72 and 74. Further, screws 84 are provided and threadedly engaged with the platform so that the position of the platform may be adjusted vertically with respect to the frame and secured to rails 72 and 74 in a desired position by screws 84.

In FIG. 3, mandrel 32 and traffic cone 50 have been lowered from the first position shown in FIGS. 1 and 2 to a second position. In the second position, the tangent line 86 of the portion of upright member 54 of traffic cone 50 closest to end edges 64*a*, 64*b* of the reflective sleeves 60*a*, 60*b* respectively, is parallel to and spaced therefrom. Longitudinal axis 33 of the mandrel is inclined downwardly with respect to the platform at the angle of taper of the traffic cone. If traffic cone 50 included a cylindrical upright member (not shown), longitudinal axis 33 of the mandrel and tangent line 86 of the traffic cone would be parallel to each other and to the line 68 on the platform.

Means are provided to shift the platform between first and second positions in order to place the end edge of the reflective sleeve in contact with the traffic cone at the nearest tangent point of the traffic cone. Although the platform may be shifted in any desired manner, in the illustrated embodiment, the platform is rotated about an axis 87 generally parallel to the tangent line 68 of the traffic cone when the traffic cone and the mandrel are in their second position. Axis 87 is also generally perpendicular to axis 41 about which the mandrel rotates between its first and second positions.

As shown, one edge 88 of the platform 14 is hingedly mounted to frame 12 to form axis 87. Double acting second pneumatic cylinder 90 is mounted with one end mounted on frame 12 and the other end connected to platform 14 spaced from the hinged connection 88. By activating second pneumatic cylinder 90 and extending its shaft in direction 92, platform 14 rotates upwardly in rotational direction 94 from its first position to its second, upper position, shown in FIG. 4. Retraction of the shaft of the second pneumatic cylinder 90 in direction 96 will rotate platform 14 in opposite rotational direction 98 back to its first position. The location of edges 64*a*, 64*b* of the reflective sleeves aligned with line 68 on the platform is determined so that when the platform is rotated to its second position, the edges 64*a*, 64*b* and the pressure sensitive adhesive surface of the sleeves are brought into contact with the tangent line 86 of the traffic cone. Of course, platform 14 may be constructed so that it may be raised vertically, eliminating the hinged connection 88.

The relative motion of mandrel 32 supporting traffic cone 50 and platform 14 supporting reflective sleeves 60*a*, 60*b* places the traffic cone in contact with the reflective sleeves without disturbing the position of the sleeves. If the rotative motion of mandrel 32 in direction 40 is allowed to place traffic cone 50 in contact with the reflective sleeves, the traffic cone will first encounter the upper sleeve 60*a*. Continued rotative motion of the traffic cone required to fully contact the both sleeves 60*a*, 60*b* will tend to pull the sleeves in direction 76, with obvious disadvantageous results for the accuracy in placement of the reflective sleeves on the traffic cone.

Figure 4:
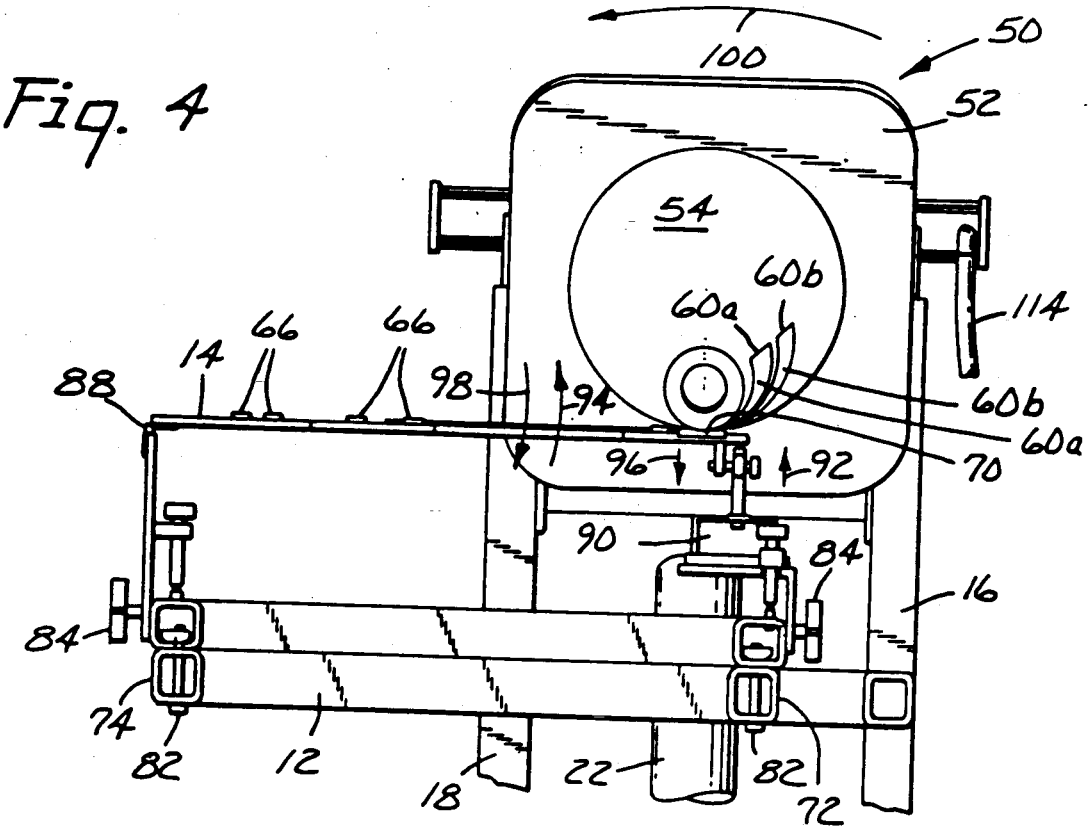
FIG. 4 is a front view of a portion of the apparatus of FIGS. 1–3 with the platform raised to a second position to place the traffic cone in contact with the reflective sleeves and with the reflective sleeves partially applied to the traffic cone.
Figure 5:
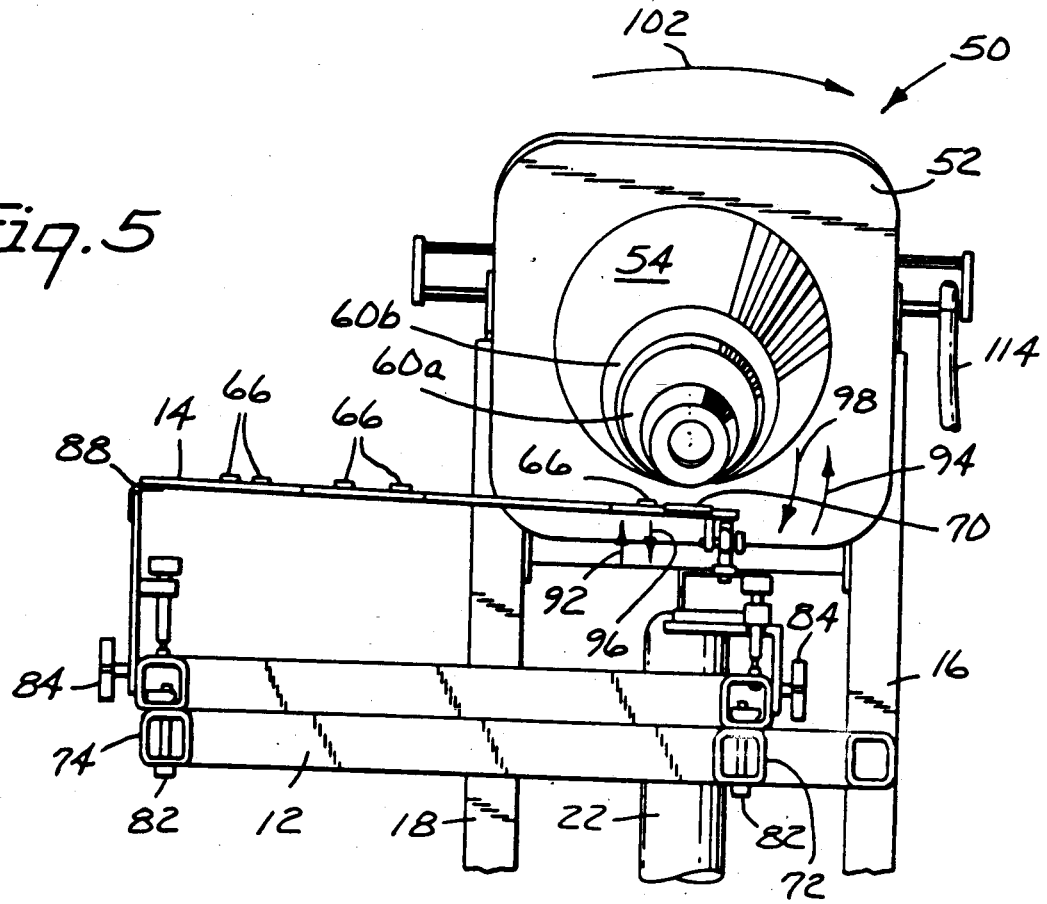
FIG. 5 is a front view of the portion of the apparatus shown in FIG. 4 with the reflective sleeves applied to the traffic cone and the platform lowered to its first position.

As is then also shown in FIG. 4, once the traffic cone is placed in contact with the reflective sleeves, traffic cone 50 is rotated in direction 100 about longitudinal axis 33 of mandrel 32 (which is axially aligned with the longitudinal axis of the traffic cone) by activating motor 26 so as to wind the reflective sleeves 60*a*, 60*b* about the traffic cone. Reflective sleeves 60*a*, 60*b* are preferably constructed so that end edges 64*a*, 64*b* of each sleeve overlap slightly when applied to the traffic cone to ensure effective adherence thereto. Preferably, the traffic cone is rotated through 1¼ turns to ensure effective application of the reflective sleeves thereto. After reflective sleeves 60*a*, 60*b* are wound upon traffic cone 50, platform 14 is rotated in direction 98 back to its first position by retracting the shaft of the second pneumatic cylinder 90 in direction 96, as shown in FIG. 5.

Figure 6:
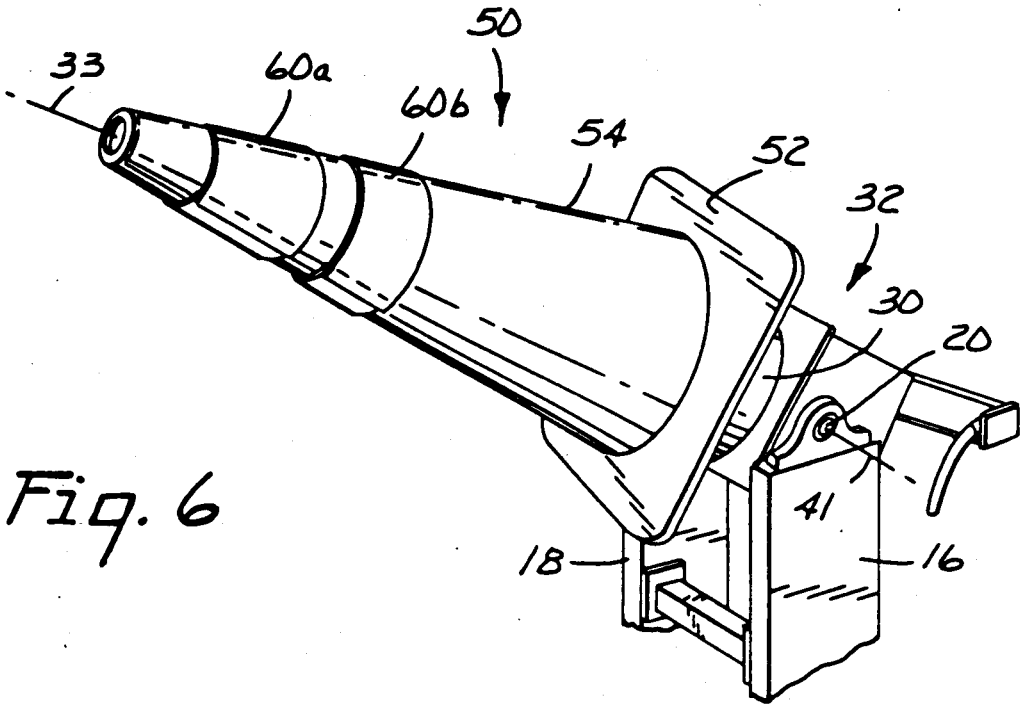
FIG. 6 is an isometric view of a portion of the apparatus of FIGS. 1–5 with the reflective sleeves applied to the traffic cone and the mandrel raised to its first position.
Figure 7:
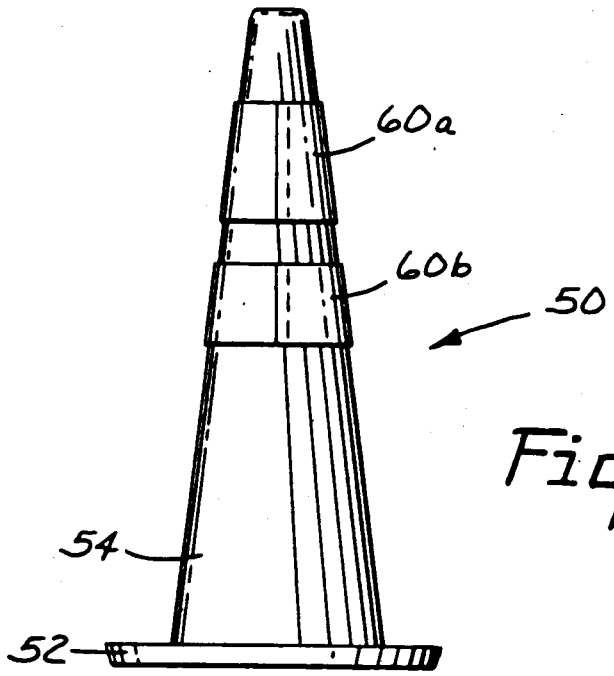
FIG. 7 is a plan view of a traffic cone with the reflective sleeves applied and removed from the apparatus of FIGS. 1–6.

With platform 14 disengaged, mandrel 32 may be shifted back to its first position by retracting the shaft of first pneumatic cylinder 22 in direction 44, as shown in FIG. 6. During the process of raising mandrel 32 to its first position, motor 26 is again activated so as to quickly rotate the mandrel and traffic cone in opposite rotational direction 102. This returns mandrel 32 and motor 26 to their original positions and acts to loosen or dislodge the traffic cone from the mandrel. The traffic cone with reflective sleeves 60*a*, 60*b* applied may then be easily removed from the mandrel. FIG. 7 illustrates a traffic cone with the reflective sleeves in place and ready for use.

Figure 8:
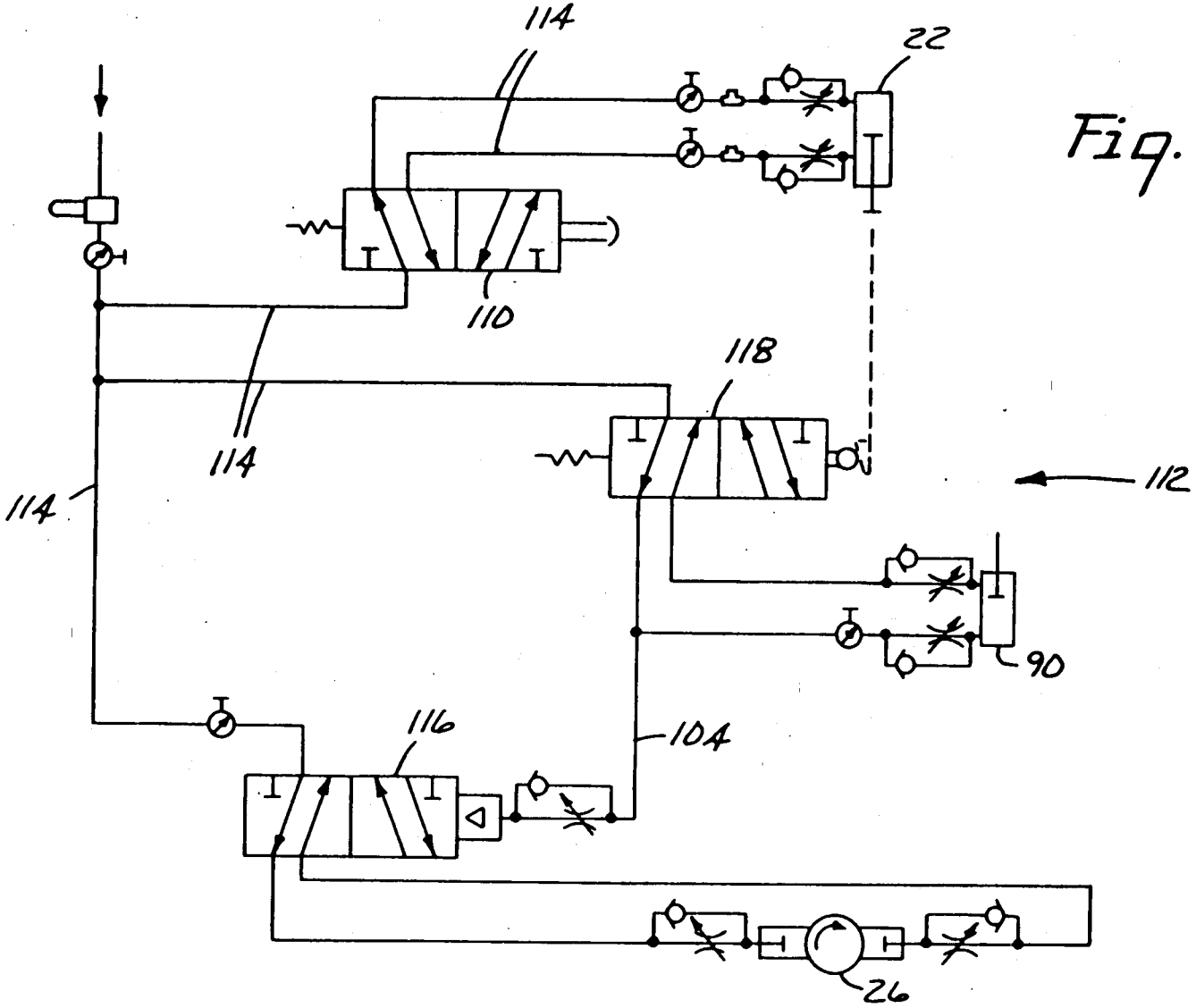
FIG. 8 is a schematic representation of a pneumatic circuit for controlling the apparatus of this invention.

Although each of the steps of the present invention may be controlled manually, in the preferred embodiment of the invention, the motion and timing of the mandrel and platform are automatically controlled by a pneumatic circuit and activated by foot switch 110, shown in FIGS. 1 and 2. FIG. 8 is a schematic representation of one such pneumatic circuit 112 for activating and controlling the first and second pneumatic cylinders 22 and 90 and the pneumatic motor 26. The pneumatic circuit is connected to a source of compressed air (not shown) which may conveniently be regulated to a pressure of approximately 60 p.s.i. The pneumatic circuit 112 includes portions of pneumatic conduit 114 connecting the various components of the circuit, which also includes time delay 116 (such as a PA-40 TM brand time delay available from Numatics Incorporated of Highland, Michigan) and limit switch 118 (neither shown in any of the previous figures).

In operation, the operator of the apparatus depresses foot switch 110, which activates first pneumatic cylinder 22 to shift the mandrel from its first position to its second position. The limit switch 118 is mounted on the frame adjacent the brackets 16 and 18. The location of the second position of the mandrel is determined by an adjustable screw (not shown) mounted on the mandrel so as to come in contact with limit switch 118 as the mandrel moves in rotational direction 40 and thereby interrupt the supply of compressed air to first pneumatic cylinder 22 and prevent further movement of the mandrel. The flow of the compressed air to second pneumatic cylinder 90 is regulated so that the movement of the platform from its first to its second position is achieved only after the mandrel and traffic cone have achieved their second position. Alternatively, a second time delay could be utilized in conjunction with foot switch 110 to control movement of the platform.

Further, time delay 116 initiates the activation of motor 26 in rotational direction 100 only after the platform reaches its second position and places the traffic cone in contact with the pressure sensitive adhesive surface of the reflective sleeves. After the application of the reflective sleeves to the traffic cones, removal of the operators foot from foot switch 110 reactivates the first and the second pneumatic cylinders 22 and 90, respectively, to return the mandrel and the platform to their respective first positions. Preferably, the motor 26 is likewise activated to rotate the mandrel in rotational direction 102, which returns the motor to its initial position. After removal of the traffic cone, the apparatus is in position for receipt of a new traffic cone and reflective sleeves. Of course, electrical or other known power and control devices may be substituted for the pneumatic devices and pneumatic circuit discussed herein, if desired.

The present invention has now been described with reference to an embodiment thereof. It will be apparent to those skilled in the art that many changes can be made in the embodiments described without departing from the scope of the present invention. Thus, the scope of the present invention should not be limited to the structures described in this application, but only by structures described by the language of the claims and the equivalents of those structures.

What is claimed is:

1. Apparatus for applying a reflective sleeve having spaced end edges to a traffic cone, comprising:

(a) a frame;

(b) a mandrel having a longitudinal axis mounted on said frame for receiving the traffic cone and including means for securing the traffic cone on said mandrel;

(c) a platform mounted on said frame for supporting the reflective sleeve with a pressure sensitive adhesive surface of the reflective sleeve exposed;

(d) mandrel motive means mounted on said frame and connected to said mandrel for shifting said mandrel with the traffic cone secured thereon between a first position and a second position when said mandrel motive means is activated, wherein in said second position said longitudinal axis remains stationary with respect to said frame, so that a tangent line of the traffic cone nearest to said platform is parallel to and spaced from an end edge of the sleeve;

(e) means mounted on said frame for shifting said platform between a first position to a second position with said mandrel in said second position to place the pressure sensitive adhesive surface of the adhesive sleeve along said end edge thereof in contact with the traffic cone at the nearest tangent line; and (f) means mounted on said frame for rotating said mandrel about said longitudinal axis to wind the sleeve onto the traffic cone.

2. The apparatus of claim 1, wherein said means for shifting said mandrel between said first position and said second position includes a limit switch operatively connected to said mandrel motive means wherein said limit switch deactivates said mandrel motive means when said mandrel reaches its second position.

3. The apparatus of claim 1, wherein said means for shifting said platform between said first and second positions includes a platform motive means mounted on said frame and connected to said platform, wherein one edge of said platform aligned with said longitudinal axis of said mandrel is pivotally mounted on said frame so that said platform is rotated between said first and second positions when said platform motive means is activated.

4. The apparatus of claim 1, wherein said means for rotating said mandrel about said longitudinal axis includes a motive means operatively connected to said mandrel, wherein said mandrel may be rotated in either rotational direction when said motive means is activated.

5. The apparatus of claim 1, further comprising means for delaying the shifting of said platform from said first position to said second position until said mandrel is in said second position.

6. The apparatus of claim 1, wherein said mandrel is rotated between said first position and said second position.

7. The apparatus of claim 6, wherein said platform is rotated between said first position and said second position.

8. Apparatus for applying a reflective sleeve having spaced end edges to a traffic cone, comprising:

(a) a frame;

(b) a mandrel having a longitudinal axis mounted on said frame for receiving the traffic cone and including means for securing the traffic cone on said mandrel, wherein said mandrel includes a stationary portion and an adjustable portion mounted on said stationary portion and adapted for reciprocal movement with respect to said stationary portion, and including means for resiliently urging said adjustable portion away from said stationary portion, said stationary portion and said adjustable portion each having a tapered exterior adapted for receipt of the traffic cone, wherein said adjustable portion is shifted towards said stationary portion when the traffic cone is mounted on the mandrel so that the traffic cone is securely mounted thereon and supported when the reflective sleeve is applied;

(c) a platform mounted on said frame for supporting the reflective sleeve with a pressure sensitive adhesive surface of the reflective sleeve exposed;

(d) means mounted on said frame for shifting said mandrel with the traffic cone secured thereon between a first position and a second position, wherein in said second position said longitudinal axis remains stationary with respect to said frame, so that a tangent line of the traffic cone nearest to said platform is parallel to and spaced from an end edge of the sleeve;

(e) means mounted on said frame for shifting said platform between a first position to a second position with said mandrel in said second position to place the pressure sensitive adhesive surface of the adhesive sleeve along said end edge thereof in contact with the traffic cone at the nearest tangent line; and (f) means mounted on said frame for rotating said mandrel about said longitudinal axis to wind the sleeve onto the traffic cone.

9. Apparatus for applying a reflective sleeve having spaced end edges to a traffic cone, comprising:

(a) a frame;

(b) a mandrel having a longitudinal axis mounted on said frame for receiving the traffic cone and including means for securing the traffic cone on said mandrel;

(c) a platform mounted on said frame for supporting the reflective sleeve with a pressure sensitive adhesive surface of the reflective sleeve exposed, wherein said platform includes means for locating an edge of the reflective sleeve on said platform with respect to the nearest tangent line of the traffic cone when said platform and said mandrel are in their second positions;

(d) means mounted on said frame for shifting said mandrel with the traffic cone secured thereon between a first position and a second position, wherein in said second position said longitudinal axis remains stationary with respect to said frame, so that a tangent line of the traffic cone nearest to said platform is parallel to and spaced from an end edge of the sleeve;

(e) means mounted on said frame for shifting said platform between a first position to a second position with said mandrel in said second position to place the pressure sensitive adhesive surface of the adhesive sleeve along said end edge thereof in contact with the traffic cone at the nearest tangent line; and (f) means mounted on said frame for rotating said mandrel about said longitudinal axis to wind the sleeve onto the traffic cone.

10. The apparatus of claim 9, wherein said locating means includes one or more stops mounted on said platform, each of said stops for contact with an edge of the reflective sleeve.

11. The apparatus of claim 10, wherein the location of said stops on said platform is adjustable.

12. A method for applying a reflective sleeve having spaced end edges and having a pressure sensitive adhesive coated on one major surface, onto a traffic cone, comprising the steps of:

(a) providing a mandrel having a longitudinal axis for supporting the traffic cone;

(b) providing a platform for supporting the reflective sleeve with the pressure sensitive adhesive surface exposed;

(c) rotating the mandrel from a first position to a second position about an axis perpendicular to the longitudinal axis of the mandrel with the tangent line of the traffic cone in the second position parallel to but spaced apart from the end edge;

(d) moving the platform relative to the mandrel to place the pressure sensitive adhesive surface of the reflective sleeve at the adjacent end edge in contact with the traffic cone at the nearest tangent line;

(e) rotating the mandrel about its longitudinal axis to wind the reflective sleeve about the traffic cone, while said longitudinal axis remains stationary;

(f) moving the mandrel and the traffic cone away from the platform; and (g) removing the traffic cone with the reflective sleeve from the mandrel.

13. The method of claim 12, wherein step (d) includes the step of rotating the platform from a first position to a second position to place the pressure sensitive adhesive surface of the reflective sleeve at the adjacent end edge in contact with the traffic cone at the tangent line.

14. The apparatus of claim 1, wherein the length of the reflective sleeve is greater than the circumference of the traffic cone, such that the ends of the sleeve overlap when the sleeve is applied to the traffic cone.

15. The method of claim 12 wherein step (e) further comprises rotating the mandrel through more than one complete revolution about its longitudinal axis.

16. Apparatus for applying a reflective sleeve having spaced end edges to a conical traffic cone, comprising:

(a) a frame;

(b) a conical mandrel having a longitudinal axis mounted on said frame for receiving the traffic cone and including means for securing the traffic cone on said mandrel;

(c) a platform mounted on said frame for supporting the reflective sleeve with a pressure sensitive adhesive surface of the reflective sleeve exposed;

(d) means mounted on said frame for shifting said mandrel with the traffic cone secured thereon between a first position and a second position, wherein in said second position said longitudinal axis remains stationary with respect to said frame, so that a tangent line of the traffic cone nearest to said platform is parallel to and spaced from an end edge of the sleeve;

(e) means mounted on said frame for shifting said platform between a first position to a second position with said mandrel in said second position to place the pressure sensitive adhesive surface of the adhesive sleeve along said end edge thereof in contact with the traffic cone at the nearest tangent line; and (f) means mounted on said frame for rotating said mandrel about said longitudinal axis to wind the sleeve onto the traffic cone.

17. The apparatus of claim 1, wherein said mandrel motive means comprises a pneumatic cylinder connected to a source of compressed air, such that activation of the cylinder causes the mandrel to shift from said first position to said second position, and deactivation of the cylinder causes the mandrel to shift from said second position to said first position.

18. The apparatus of claim 2, wherein said mandrel motive means comprises a pneumatic cylinder, and said limit switch is a pneumatic limit switch.

19. The apparatus of claim 3, wherein said platform motive means comprises a pneumatic cylinder which is connected to a source of pressurized air, such that activation of said cylinder causes the platform to shift from said first position to said second position, and deactivation of said cylinder causes the platform to shift from said second position to said first position.

20. The apparatus of claim 4, wherein said motive means comprises a pneumatic motor and a source of pressurized air.

* * * * *